US009540969B2

(12) United States Patent
Yamaguchi et al.

(10) Patent No.: US 9,540,969 B2
(45) Date of Patent: Jan. 10, 2017

(54) VARIABLE VALVE MECHANISM OF INTERNAL COMBUSTION ENGINE

(71) Applicant: OTICS CORPORATION, Nishio-shi (JP)

(72) Inventors: Koki Yamaguchi, Nishio (JP); Masatoshi Sugiura, Nishio (JP); Naoki Hiramatsu, Nishio (JP)

(73) Assignee: OTICS CORPORATION, Nishio-shi, Aichi-ken (JP)

( * ) Notice: Subject to any disclaimer, the term of this patent is extended or adjusted under 35 U.S.C. 154(b) by 0 days.

(21) Appl. No.: 14/856,347

(22) Filed: Sep. 16, 2015

(65) Prior Publication Data

US 2016/0108779 A1 Apr. 21, 2016

(30) Foreign Application Priority Data

Oct. 21, 2014 (JP) ..... 2014-214285

(51) Int. Cl.
*F01L 1/18* (2006.01)
*F01L 13/00* (2006.01)

(52) U.S. Cl.
CPC ..... *F01L 13/0021* (2013.01); *F01L 1/18* (2013.01); *F01L 1/185* (2013.01); *F01L 13/0005* (2013.01); *F01L 2001/186* (2013.01)

(58) Field of Classification Search
CPC ..... F01L 1/18; F01L 1/185; F01L 13/0005; F01L 13/0021; F01L 2001/186
USPC ..... 123/90.16, 90.39, 90.44, 90.45, 90.46
See application file for complete search history.

(56) References Cited

U.S. PATENT DOCUMENTS 7,730,861 B2 * 6/2010 Ng ..... F01L 1/185 123/90.39
2004/0074459 A1 4/2004 Hayman et al.

FOREIGN PATENT DOCUMENTS

| | | | |
|---|---|---|---|
| DE | 10 2004 029 555 | A1 | 1/2006 |
| EP | 0 323 234 | A1 | 7/1989 |
| EP | 0 343 931 | A1 | 11/1989 |
| EP | 2 224 106 | A1 | 9/2010 |
| EP | 2 711 510 | A1 | 3/2014 |
| FR | 2 758 857 | A1 | 7/1998 |
| GB | 2 185 784 | A | 7/1987 |

OTHER PUBLICATIONS

Extended European Search Report dated Mar. 18, 2016.

* cited by examiner

*Primary Examiner* — Ching Chang
(74) *Attorney, Agent, or Firm* — McGinn IP Law Group, PLLC

(57) ABSTRACT

The present invention provides a variable valve mechanism, which includes a rocker arm including an input member and an output member; a switching device that switches a drive state of the valve by displacing the switching pin between a coupling position at which the switching pin extends between the first pinhole in the input member and the second pin hole in the output member and a non-coupling position at which the switching pin does not extend; and a lost motion spring. A displacement clearance is formed between an inner peripheral surface of the first or second pin hole and an outer peripheral surface of the switching pin to permit the relative displacement in a range of the displacement clearance at a coupled time so that a tappet clearance is not formed with the input member urged toward the cam by the lost motion spring.

9 Claims, 10 Drawing Sheets

VARIABLE VALVE MECHANISM OF INTERNAL COMBUSTION ENGINE

TECHNICAL FIELD

The present invention relates to a variable valve mechanism that drives a valve of an internal combustion engine and that changes the drive state of the valve in accordance with the operating status of the internal combustion engine.

BACKGROUND ART

A variable valve mechanism 90 according to the related art illustrated in FIG. 10 is described in Patent Document 1. The variable valve mechanism 90 includes a rocker arm 93 swingably placed on a support member 92 that projects upward. The rocker arm 93 includes an input member 93A driven by cams 91 and 91 (high-lift cams) and an output member 93B that drives a valve 7.

The variable valve mechanism 90 further includes switching pins 96 and 96 and a hydraulic chamber 98 provided inside the rocker arm 93, and an oil passage 97 that extends to the hydraulic chamber 98 by way of the support member 92 and the rocker arm 93. The variable valve mechanism 90 switches the drive state of the valve 7 by displacing the switching pins 96 and 96 between a coupling position at which the switching pins 96 and 96 extend between the input member 93A and the output member 93B and a non-coupling position at which the switching pins 96 and 96 do not extend between the input member 93A and the output member 93B based on variations in hydraulic pressure in the oil passage 97 and the hydraulic chamber 98. The variable valve mechanism 90 further includes lost motion springs 95 and 95 that urge the input member 93A toward the cams 91 and 91 at a non-coupled time.

CITATION LIST

Patent Document

Patent Document 1: U.S. Patent Application Publication No. 2004/0074459 (US 2004/0074459)

SUMMARY OF THE INVENTION

Technical Problem

In the variable valve mechanism 90 described above, in the case where the support member 92 is not a lash adjuster that automatically compensates for a tappet clearance C or the like, the following issue occurs. That is, at a non-coupled time, the input member 93A is urged toward the cams 91 and 91 by the lost motion springs 95 and 95, and therefore the tappet clearance C is not formed between the cams 91 and 91 and the input member 93A. At a coupled time, however, the function of the lost motion springs 95 is lost by the coupling. Therefore, the tappet clearance C is formed between the base circle of the cams 91 and 91 and the input member 93A at a base circle time at the coupled time. The tappet clearance C may cause backlash of the rocker arm 93.

The tappet clearance C may further cause the following issue. That is, when a switching hydraulic pressure is applied to the oil passage 97, the rocker arm 93 may be lifted from the support member 92 by the switching hydraulic pressure by an amount corresponding to the tappet clearance C. The lift may reduce the switching hydraulic pressure, and a desired switching hydraulic pressure may not be stably obtained.

On the other hand, however, use of the lash adjuster or the like as the support member 92 should be avoided if possible for the following reasons. That is, first of all, the lash adjuster or the like is expensive. Secondly, the lash adjuster or the like may complicate the structure of the oil passage 97, and complicate the structure of the other components of the variable valve mechanism 90. Hence, use of the lash adjuster or the like should be avoided if possible for the reasons described above. Further, also in the case where the support member 92 is a lash adjuster or the like, the tappet clearance C may be formed to cause the issues described above in the case where the function of the support member 92 is not demonstrated sufficiently immediately.

It is therefore a first object to eliminate a tappet clearance using a simple structure that is different from a lash adjuster or the like. Further, it is a second object to secure the stability of a switching hydraulic pressure by preventing a lift of a rocker arm by eliminating a tappet clearance.

Solution to Problem

In order to attain the first object (to eliminate a tappet clearance), the variable valve mechanism of an internal combustion engine according to the present invention is configured as follows. That is, a variable valve mechanism of an internal combustion engine includes: a rocker arm including an input member driven by a cam and an output member that drives a valve when swung; a switching device that includes a first pin hole provided in the input member, a second pin hole provided in the output member, and a switching pin, and that switches a drive state of the valve by displacing the switching pin between a coupling position at which the switching pin extends between the first pin hole and the second pin hole and a non-coupling position at which the switching pin does not extend between the first pin hole and the second pin hole; and a lost motion spring that urges the input member toward the cam at a non-coupled time when the switching pin is disposed at the non-coupling position. In the variable valve mechanism, a displacement clearance in a direction of relative displacement of the input member with respect to the output member at the non-coupled time is formed between an inner peripheral surface of the first or second pin hole and an outer peripheral surface of the switching pin to permit the relative displacement in a range of the displacement clearance at a coupled time when the switching pin is disposed at the coupling position so that a tappet clearance is not formed between a base circle of the cam and the input member with the input member urged toward the cam by the lost motion spring also at the coupled time.

The rocker arm is not specifically limited, and examples of the rocker arm include the following aspects a and b. The aspect b is preferable in that the variable valve mechanism is made simpler by removing functional redundancy.

[a] The rocker arm is swingably supported by a support member (such as a lash adjuster) that automatically compensates for the tappet clearance.

[b] The rocker arm is swingably supported by a support member that does not automatically compensate for the tappet clearance.

The switching device is not specifically limited, and examples of the switching device include the following aspects c and d. The aspect d is preferable in that the second object (to secure a switching hydraulic pressure) is also attained.

[c] The switching device includes a pressing device provided outside the rocker arm, and is configured to displace the switching pin by the pressing device pressing the switching pin.

[d] The rocker arm is swingably placed on a support member that projects upward; and the switching device includes a hydraulic chamber provided inside the rocker arm, and an oil passage that extends to the hydraulic chamber by way of the support member and the rocker arm, and is configured to displace the switching pin based on variations in hydraulic pressure in the oil passage and the hydraulic chamber.

Advantageous Effects of Invention

According to the present invention, the tappet clearance can be eliminated using a simple structure that is different from a lash adjuster or the like by providing the displacement clearance. In the case of the switching device according to the aspect d described above (including an oil passage that extends by way of the support member and the rocker arm), further, a lift of the rocker arm due to the switching hydraulic pressure can also be prevented at the same time by eliminating the tappet clearance. Therefore, it is possible to secure the stability of the switching hydraulic pressure by securing the sealability of the oil passage at the boundary portion between the support member and the rocker arm.

DESCRIPTION OF EMBODIMENTS

Figure 1:
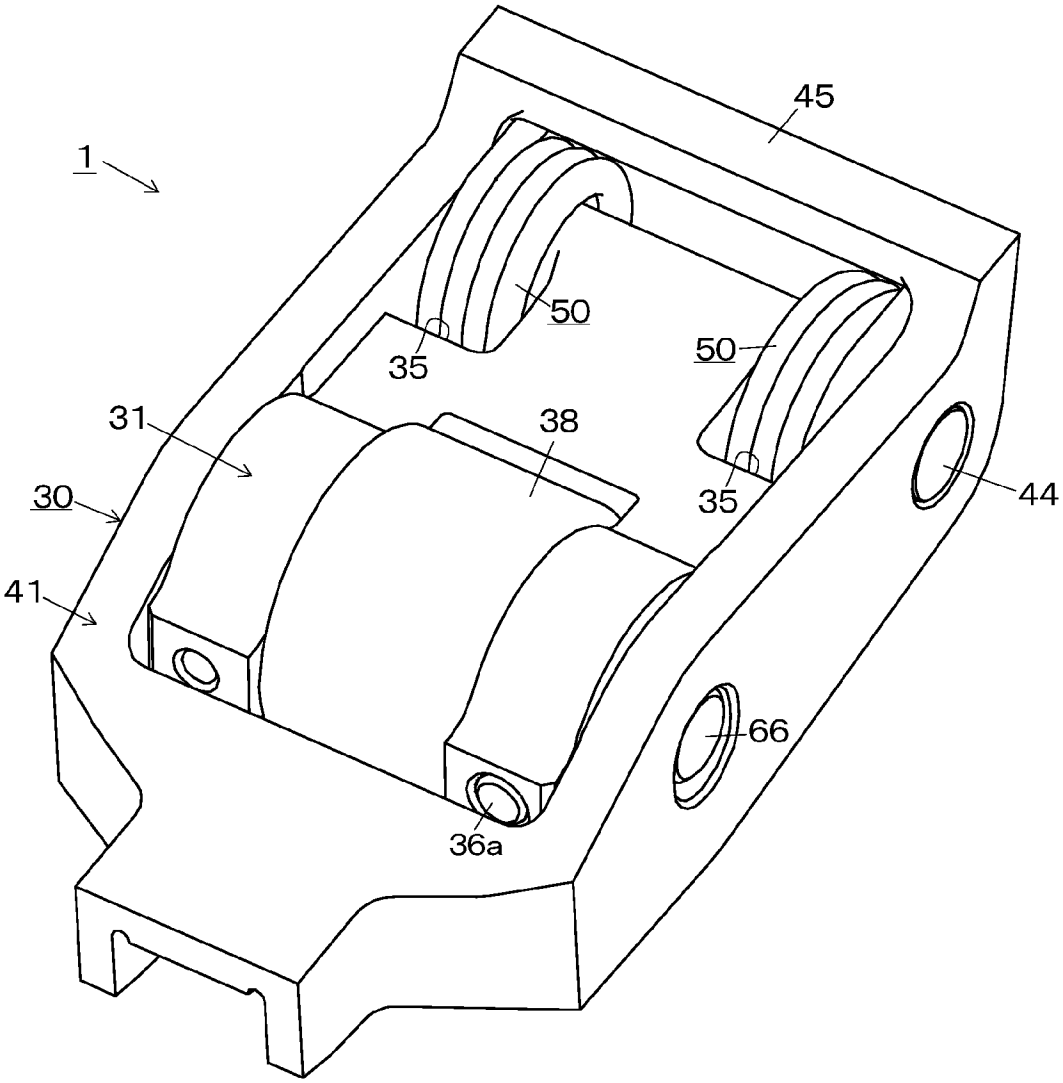
FIG. 1 is a perspective view illustrating a rocker arm of a variable valve mechanism according to a first embodiment.
Figure 2A:
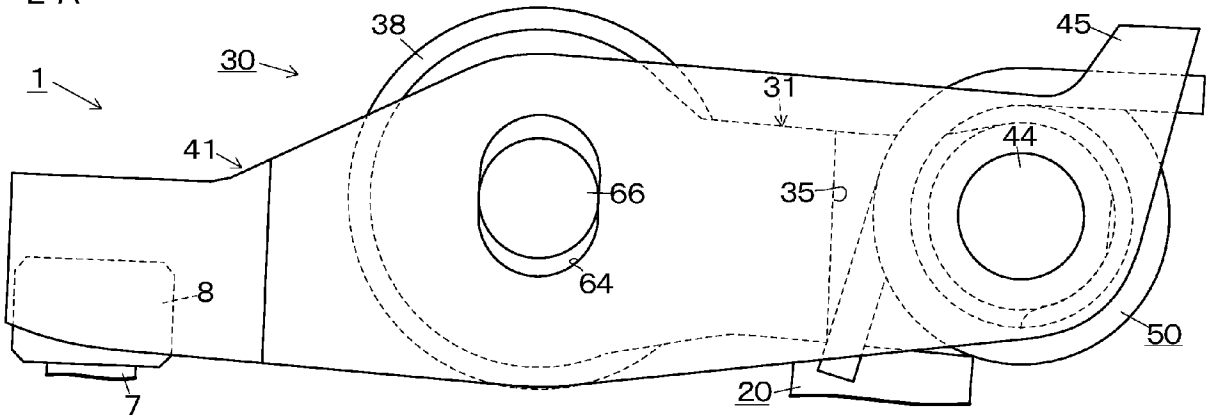
FIG. 2A is a side view.
Figure 2B:
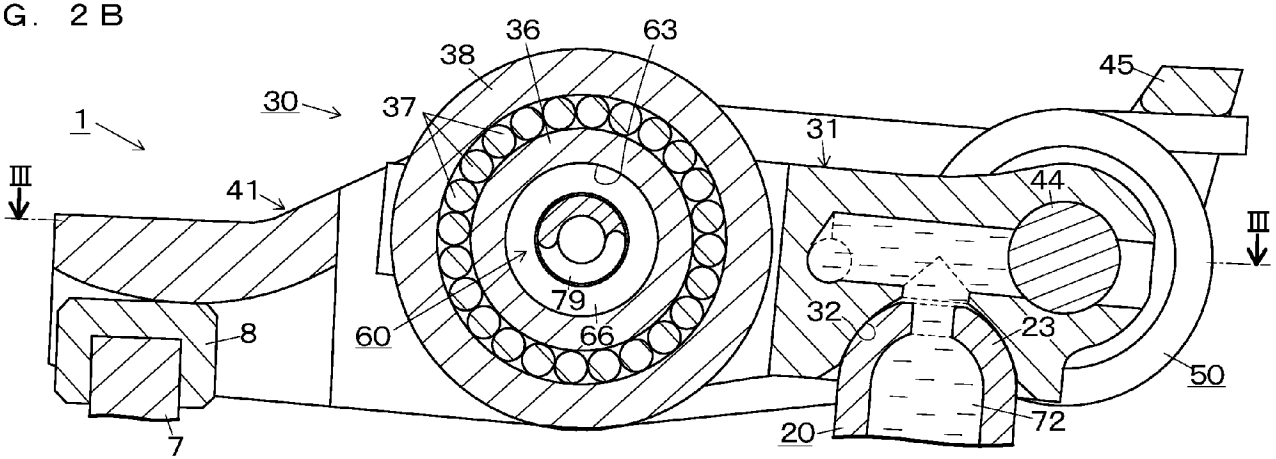
FIG. 2B is a side sectional view (a IIB-IIB sectional view illustrated in FIG. 3), respectively, illustrating the variable valve mechanism according to the first embodiment.
Figure 3:
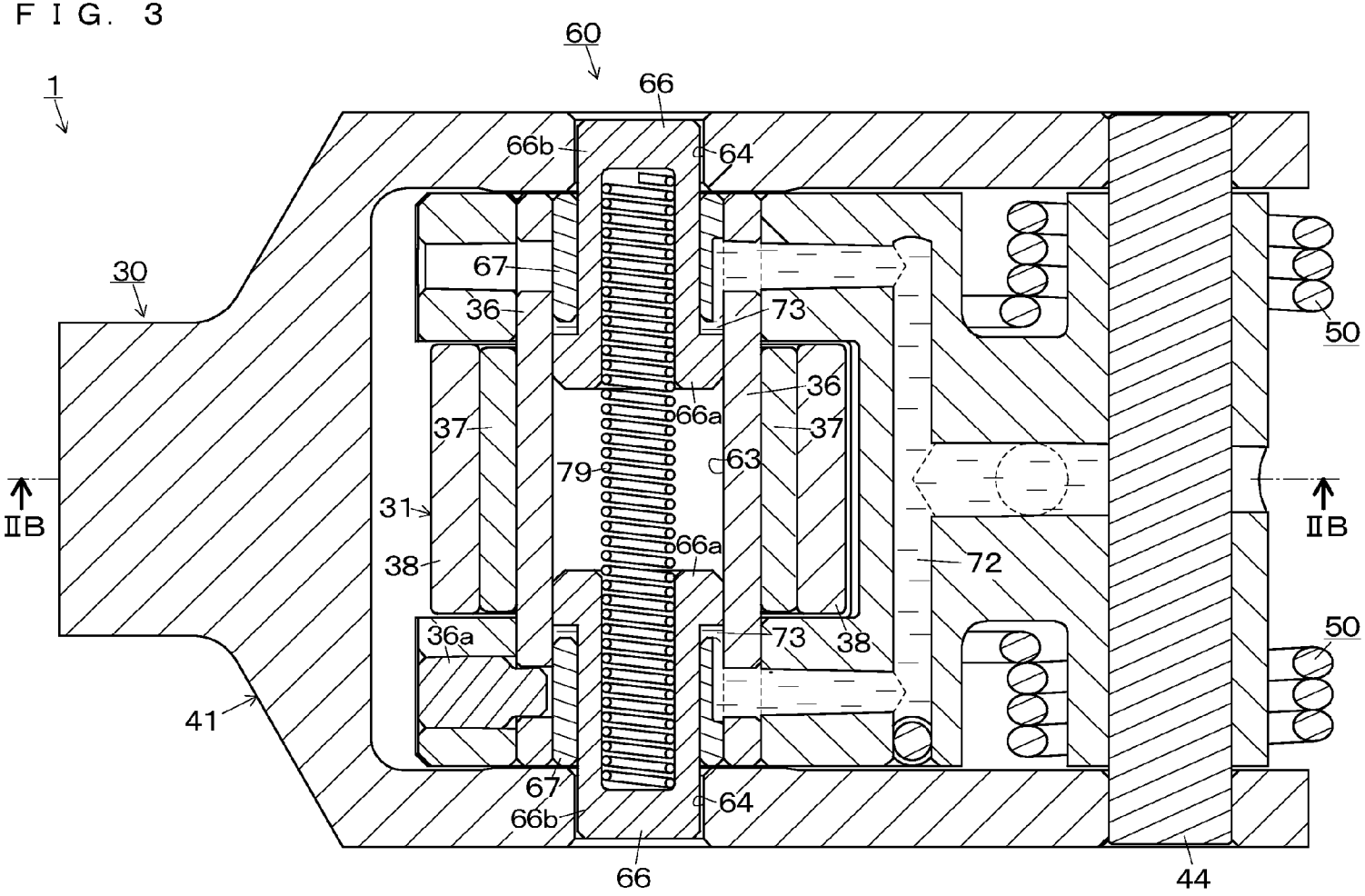
FIG. 3 is a plan sectional view (a III-III sectional view illustrated in FIG. 2B) illustrating the variable valve mechanism according to the first embodiment.

The lost motion spring is not specifically limited, and examples of the lost motion spring include the following aspects e and f. The aspect f is preferable in that the output member can be prevented from fluttering without providing a different cam.

[e] The variable valve mechanism includes a different cam that is different from the cam and that abuts against the output member at the non-coupled time, and the lost motion spring is configured to press a cylinder head using a reaction force generated when the input member is urged toward the cam at the non-coupled time.

[f] the variable valve mechanism does not include a different cam that is different from the cam and that abuts against the output member at the non-coupled time, and the lost motion spring is configured to urge the output member toward the valve using a reaction force generated when the input member is urged toward the cam at the non-coupled time so that the output member does not flutter at the non-coupled time even without the different cam.

The size of the displacement clearance is not specifically limited. The following aspect is preferable in that the stroke of the relative displacement at the coupled time is not excessively large. That is, the cam has a profile including, as seen in a graph having a horizontal axis indicating a rotational angle of the cam and a vertical axis indicating a projection height from the base circle, two uniform velocity sections in which an inclination of the profile is constant and which are provided on an inner side of connection sections provided at both end portions of a nose section, and a main lift section provided further on an inner side of the uniform velocity sections; and the displacement clearance is formed to have such a size that permits the relative displacement only in ranges, which are included in both the connection sections and the uniform velocity sections, and that does not permit the relative displacement in the main lift section at the coupled time.

The base circle time at the coupled time is not specifically limited, and examples of the base circle time at the coupled time include the following aspects g and h. The aspect h is preferable in that the size of the displacement clearance (the size of the tappet clearance to be eliminated) can be adjusted easily.

[g] At a base circle time, in which the base circle acts, at the coupled time, the displacement clearance is formed between one end of the inner peripheral surface of the first or second pin hole in a direction of the relative displacement and the outer peripheral surface of the switching pin, and the other end of the inner peripheral surface in the direction of the relative displacement abuts against the outer peripheral surface of the switching pin.

[h] At a base circle time, in which the base circle acts, at the coupled time, the displacement clearance is formed between one end of the inner peripheral surface of the first or second pin hole in a direction of the relative displacement and the outer peripheral surface of the switching pin, and an adjustment clearance that does not permit the relative displacement is formed between the other end of the inner peripheral surface in the direction of the relative displacement and the outer peripheral surface of the switching pin.

In the aspects g and h, the size of the displacement clearance is not specifically limited, but is preferably 0.10 to 0.20 mm. If the size of the displacement clearance is less than 0.10 mm, it may be difficult to adjust the size of the displacement clearance to a desired size. If the size of the displacement clearance is more than 0.20 mm, the valve lift amount may be small more than necessary.

In the aspect h, the size of the adjustment clearance is not specifically limited, but is preferably 0.5 to 1.0 mm. If the size of the adjustment clearance is less than 0.5 mm, a sufficient adjustment width for the displacement clearance may not be secured. If the size of the adjustment clearance is more than 1.0 mm, the pin hole may be so large as to make the strength of the rocker arm low more than necessary.

The switching pin is not specifically limited, and examples of the switching pin include the following aspects i and j. The aspect j is preferable in that the relative displacement at the non-coupled time is simplified to simplify the structure of the rocker arm.

[i] The switching pin is provided near the center of swing of the input member.

[j] The input member includes a roller that rotatably abuts against the cam; and the switching pin is provided on an axis of the roller.

In the aspect d (including an oil passage that extends by way of the support member and the rocker arm), the hydraulic chamber is not specifically limited, and examples of the hydraulic chamber include the following aspects d1 and d2. The aspect d2 is preferable in that the rocker arm is unlikely to be wide.

[d1] The hydraulic chamber is provided inside the output member.

[d2] The hydraulic chamber is provided inside the input member.

First Embodiment

A variable valve mechanism 1 of an internal combustion engine according to a first embodiment illustrated in FIGS. 1 to 8 is a mechanism that periodically presses a valve 7 in the opening direction to periodically open and close the valve 7. A valve spring 9 that urges the valve 7 in the closing direction is externally fitted with the valve 7. A shim 8 that adjusts the height of the valve 7 is fitted at the stem end of the valve 7. The valve 7 may be an intake valve or an exhaust valve. The variable valve mechanism 1 includes a cam 10, a support member 20, a rocker arm 30, a lost motion spring 50, and a switching device 60.

[Cam 10]

The cam 10 is provided to project from a camshaft 19 that makes one rotation each time an internal combustion engine makes two rotations. The cam 10 includes a base circle 11 having a perfect circle cross-sectional shape, and a nose 12 that projects from the base circle 11. When seen in the graph illustrated in FIG. 8 in which the horizontal axis indicates a rotational angle θ (theta) of the cam 10 and the vertical axis indicates a projection height H from the base circle 11, a profile P of the cam 10 is configured as follows. That is, A is a base circle section, and two uniform velocity sections B2 and B2 in which an inclination P' of the profile P is constant are provided on the inner side of connection sections B1 and B1 provided at both end portions of a nose section B, and a main lift section B3 is further provided on the inner side of the uniform velocity sections B2 and B2. The variable valve mechanism 1 according to the first embodiment does not include a cam that is different from the cam 10 and that abuts against an output member 41.

[Support Member 20]

The support member 20 is installed to project upward from a cylinder head, and includes a hemispherical portion 23 having a hemispherical shape and provided at the upper end portion of the support member 20 to swingably support the rocker arm 30. The support member 20 is a simple pivot that does not automatically compensate for a tappet clearance C.

[Rocker Arm 30]

The rocker arm 30 includes an input member 31 and the output member 41. The rocker arm 30 is swingably supported by the support member 20. Particularly, the rocker arm 30 includes a hemispherical recessed portion 32 provided in the lower surface of the base end portion of the input member 31 to be recessed hemispherically. The rocker arm 30 is swingably supported on the support member 20 with the hemispherical recessed portion 32 swingably placed on the hemispherical portion 23 of the support member 20. The rocker arm 30 drives only one valve 7. Hence, the rocker arm 30 does not drive a plurality of valves.

The input member 31 is an inner arm provided on the inner side of the output member 41 in the width direction, and is driven by the cam 10. The input member 31 includes a roller shaft 36 and a roller 38 provided at the distal end portion thereof. The roller shaft 36 is a tubular shaft, and is fixed to a body portion of the input member 31 by a fixing member **36*a* such that the roller shaft 36 and the input member 31 do not turn relative to each other. The roller 38 is rotatably supported by the roller shaft 36 via bearings 37 and abuts against the cam 10**.

The output member 41 is an outer arm provided on both outer sides of the input member 31 in the width direction, and drives the valve 7 when swung. The base end portion of the output member 41 is coupled to the base end portion of the input member 31 via a fulcrum pin 44 such that the output member 41 and the input member 31 swing relative to each other. The distal end portion of the output member 41 abuts against the valve 7.

Figure 4B:
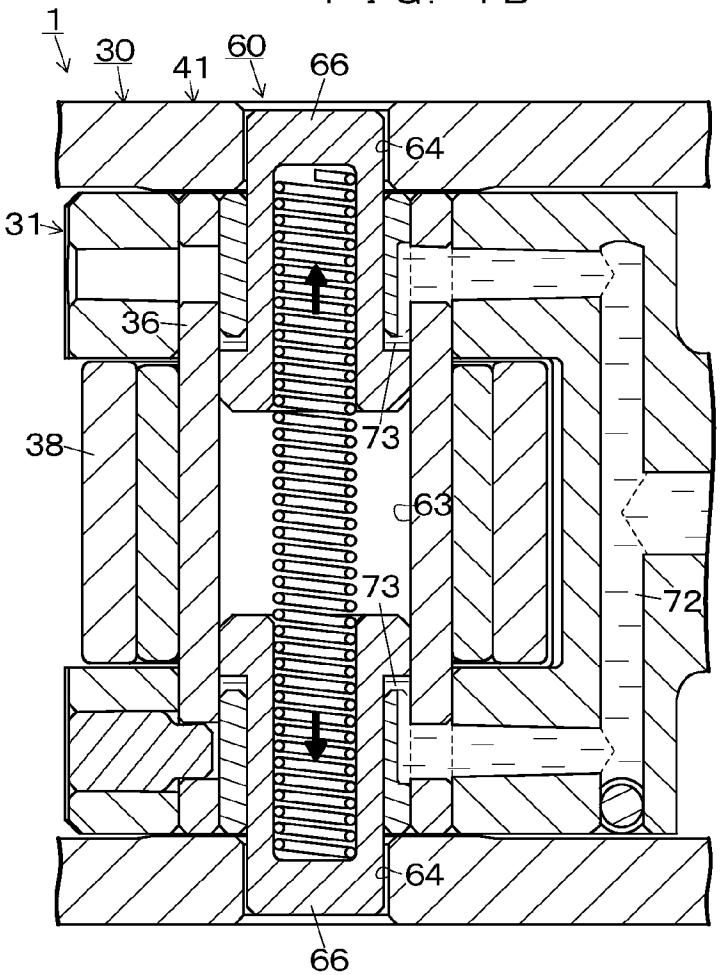
FIG. 4B is a plan sectional view illustrating the variable valve mechanism according to the first embodiment at a coupled time.
Figure 4A:
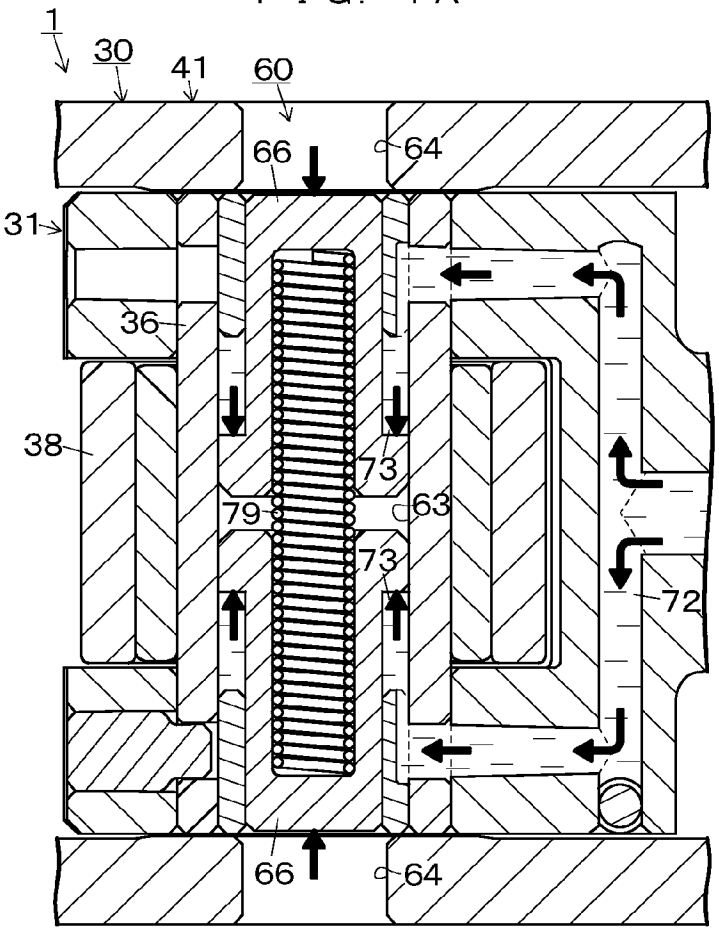
FIG. 4A is a plan sectional view illustrating the variable valve mechanism according to the first embodiment at a non-coupled time.
Figure 5B:
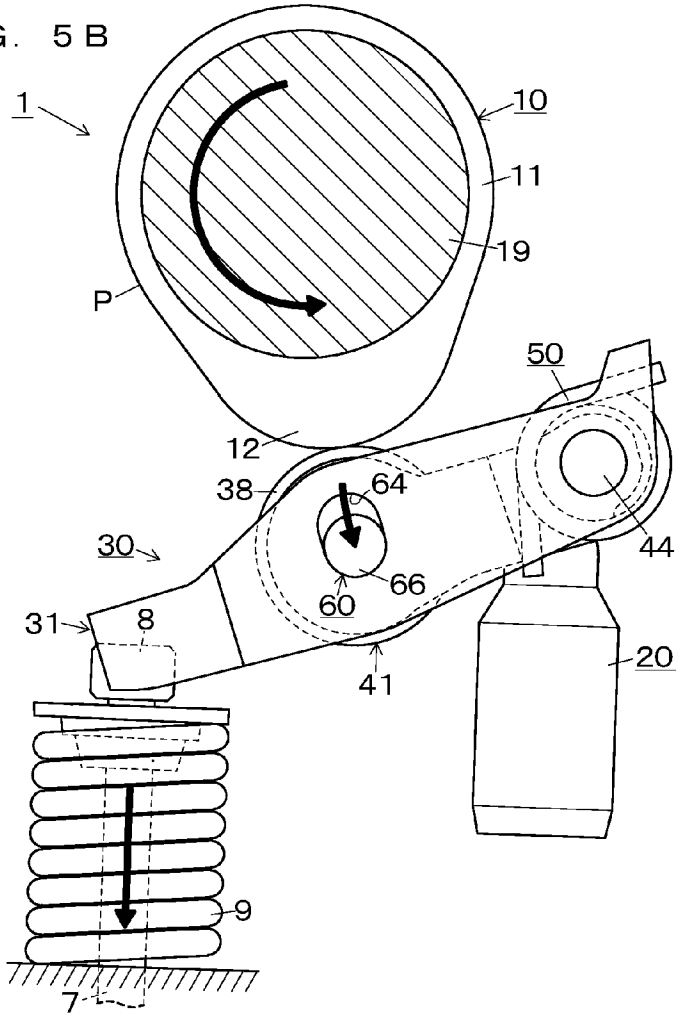
FIG. 5B is a side view illustrating the variable valve mechanism according to the first embodiment at the coupled time (at the nose time)
Figure 5A:
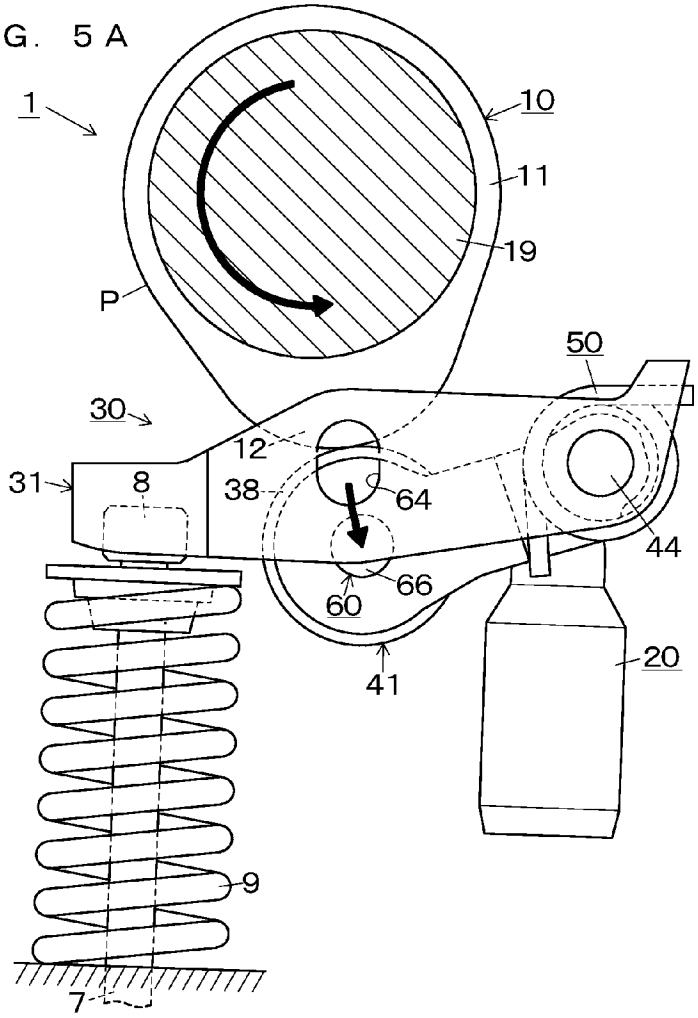
FIG. 5A is a side view illustrating the variable valve mechanism according to the first embodiment at the non-coupled time (at a nose time)

At a non-coupled time when a switching pin 66 of the switching device 60 is disposed at a non-coupling position as illustrated in FIG. 4A, the input member 31 is relatively displaced (relatively swung) with respect to the output member 41 about the fulcrum pin 44 as illustrated in FIG. 5A. Consequently, a resting state in which the valve 7 is not driven is established.

At a coupled time when the switching pin 66 of the switching device 60 is disposed at a coupling position as illustrated in FIG. 4B, on the other hand, the output member 41 is swung together with the input member 31 with the relative displacement (which refers to the relative displacement of the input member 31 with respect to the output member 41; the same applies hereinafter) restricted as illustrated in FIG. 5B. Consequently, a normal state in which the valve 7 is driven is established.

[Lost Motion Spring 50]

At the non-coupled time, the lost motion springs 50, 50 urge the input member 31 toward the cam 10, and urge the output member 41 toward the valve 7 using the reaction force. The lost motion springs 50 are interposed between the inner peripheral surface of recessed portions 35 and 35 provided to be recessed on both sides of a longitudinal-direction intermediate portion of the input member 31 and a spring abutment portion 45 provided at the base end portion of the output member 41.

[Switching Device 60]

The switching device 60 includes a first pin hole 63, second pin holes 64 and 64, the switching pin 66, a guide member 67, oil passages 72 and 72, a hydraulic chamber 73, and a return spring 79. The switching device 60 changes the drive state of the valve 7 between the normal state and the resting state by displacing the switching pins 66 and 66 between the coupling position and the non-coupling position through cooperation between variations in hydraulic pressure in the oil passage 72 and the hydraulic chambers 73 and 73 and the urging force of the return spring 79.

The first pin hole 63 is provided in the input member 31, and is specifically a tubular hole in the roller shaft 36. The second pin holes 64 and 64 are provided in the output member 41, and are specifically provided on both sides of the first pin hole 63 in its longitudinal direction. Each second pin hole 64 is a long hole that is elongated in the relative displacement direction (which refers to the direction of the relative displacement; the same applies hereinafter), that is, elongated in the direction of the circumference about the fulcrum pin 44.

At the non-coupling position, the switching pins 66 and 66 do not extend between the first pin hole 63 and the second pin holes 64 and 64. Particularly, as illustrated in FIG. 4A, the switching pins 66 and 66 are housed in the first pin hole 63. At the coupling position, meanwhile, the switching pins 66 and 66 extend between the first pin hole 63 and the second pin holes 64 and 64. Particularly, as illustrated in FIG. 4B, the distal ends of the switching pins 66 and 66 project into the second pin holes 64 and 64. Hence, the non-coupling position is relatively located on the inner side of the rocker arm 30 in the width direction, and the coupling position is relatively located on the outer side of the rocker arm 30 in the width direction. The switching pins 66 and 66 are displaced in the width direction of the rocker arm 30.

Switching is made to the resting state (non-coupled state) illustrated in FIG. 5A by increasing (turning on) the hydraulic pressure in the hydraulic chambers 73 and 73 to displace the switching pins 66 and 66 to the non-coupling position using the hydraulic pressure as illustrated in FIG. 4A. Meanwhile, switching is made to the normal state (coupled state) illustrated in FIG. 5B by reducing (turning off) the hydraulic pressure in the hydraulic chambers 73 and 73 to displace the switching pins 66 and 66 to the coupling position using the urging force of the return spring 79 as illustrated in FIG. 4B.

Figure 6B:
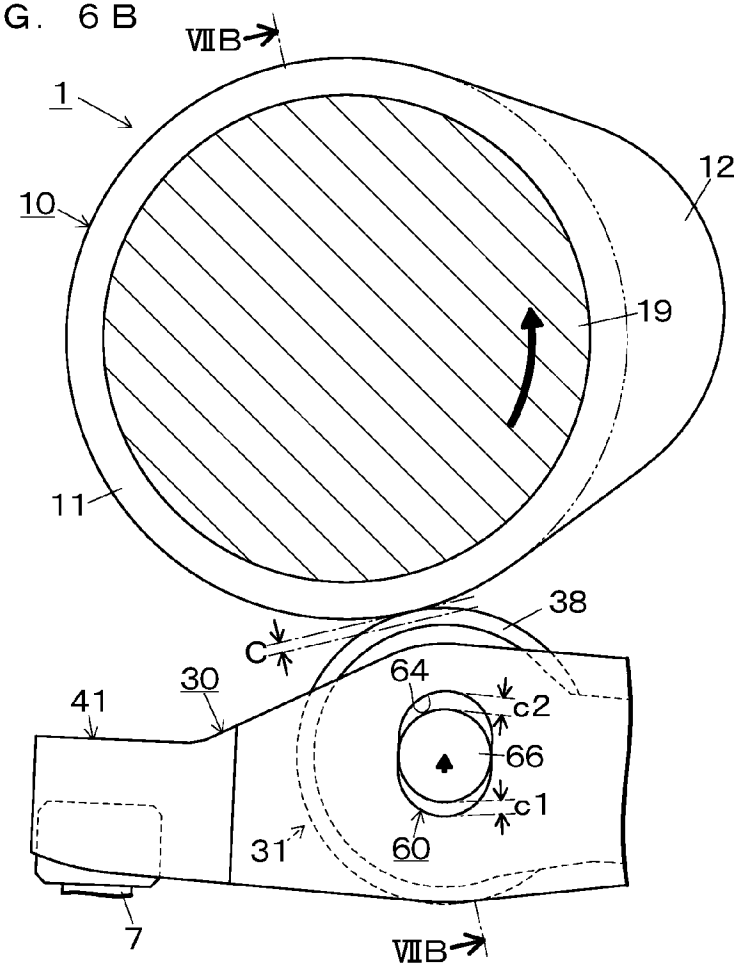
FIG. 6B is a side view illustrating the variable valve mechanism according to the first embodiment at the coupled time immediately after the transition.
Figure 6A:
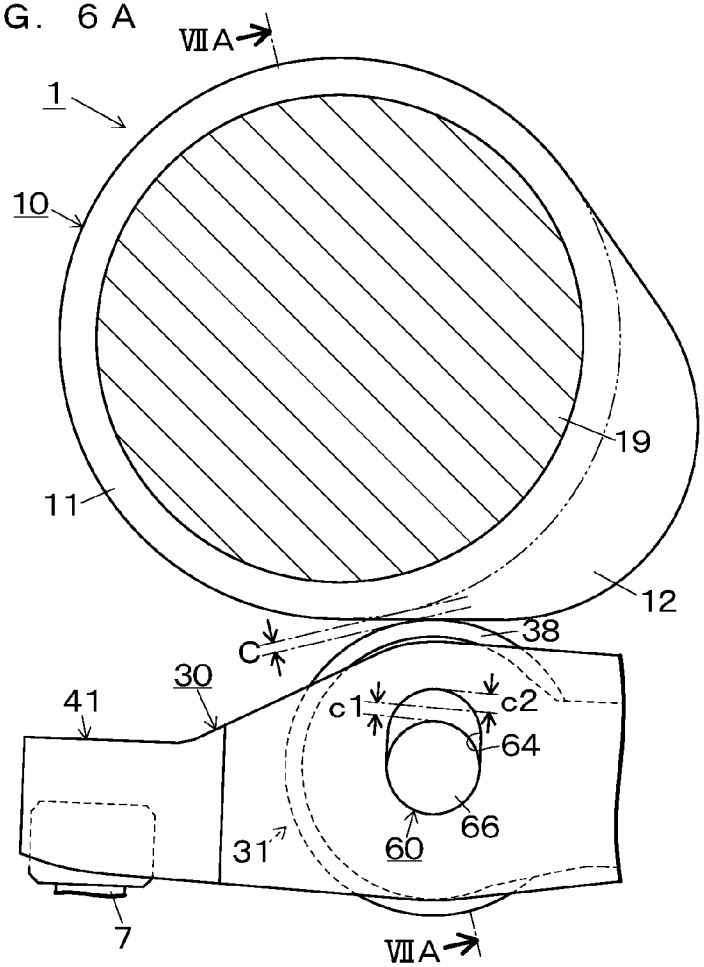
FIG. 6A is a side view illustrating the variable valve mechanism according to the first embodiment at the coupled time immediately before a transition from the nose time to a base circle time.
Figure 7B:
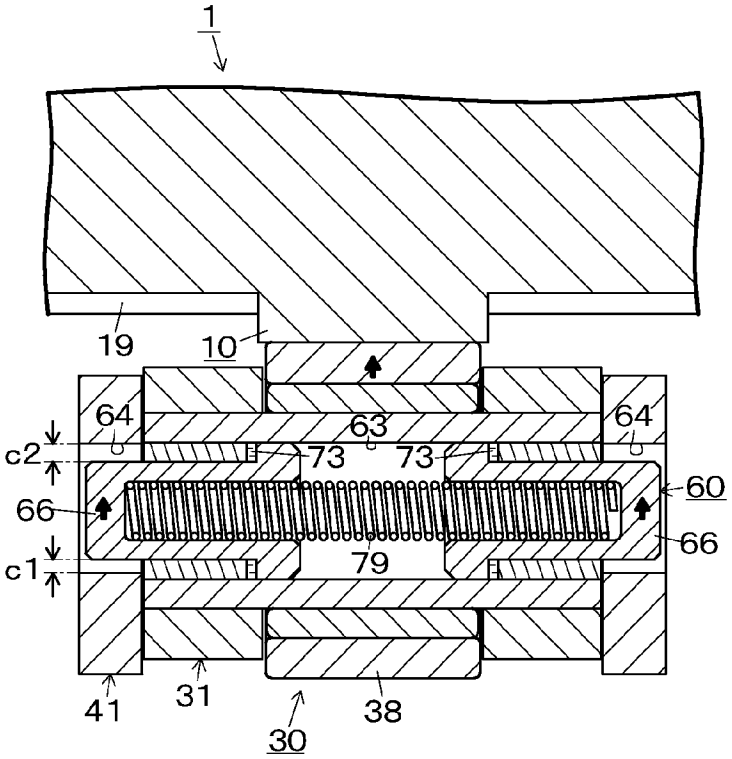
FIG. 7B is a front sectional view (a VIIB-VIIB sectional view illustrated in FIG. 6B) illustrating the variable valve mechanism according to the first embodiment at the coupled time immediately after the transition.
Figure 7A:
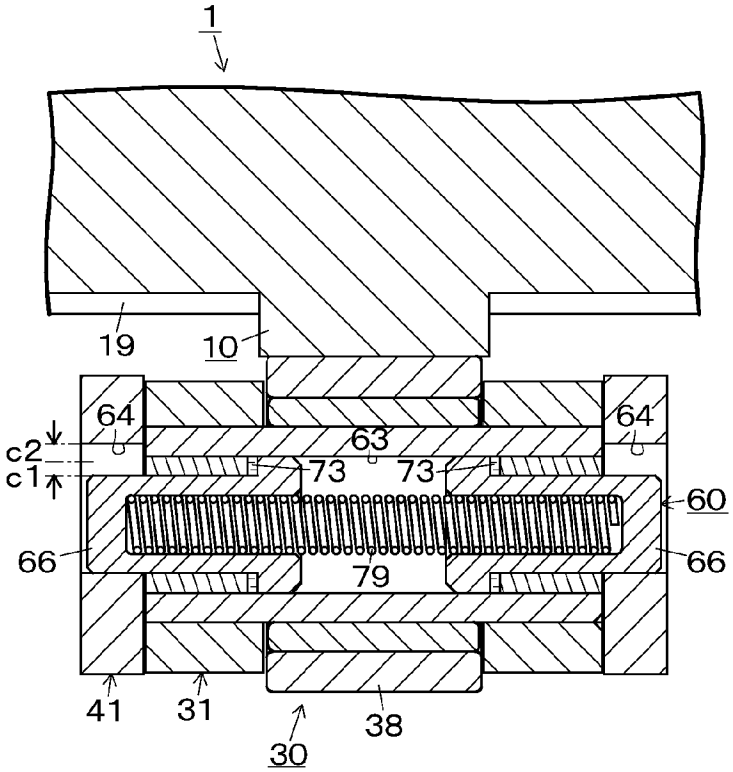
FIG. 7A is a front sectional view (a VIIA-VIIA sectional view illustrated in FIG. 6A) illustrating the variable valve mechanism according to the first embodiment at the coupled time immediately before a transition from the nose time to the base circle time.

At the coupled time (normal state), as illustrated in FIGS. 6A and 6B, a displacement clearance c1 in the relative displacement direction is formed between the inner peripheral surface of each second pin hole 64 and the outer peripheral surface of the switching pin 66 to permit the relative displacement in the range of the displacement clearance c1. Therefore, the input member 31 is urged toward the cam 10 by the lost motion spring 50 also at the coupled time. Therefore, the tappet clearance C is not formed between the base circle 11 and the input member 31 as illustrated in FIG. 6B also at a base circle time (which refers to a time when the base circle 11 acts on the input member 31; the same applies hereinafter) at the coupled time. The symbol "C" used in FIGS. 6A and 6B indicates the tappet clearance C which would originally be formed and which is not formed in the first embodiment.

Figure 8:
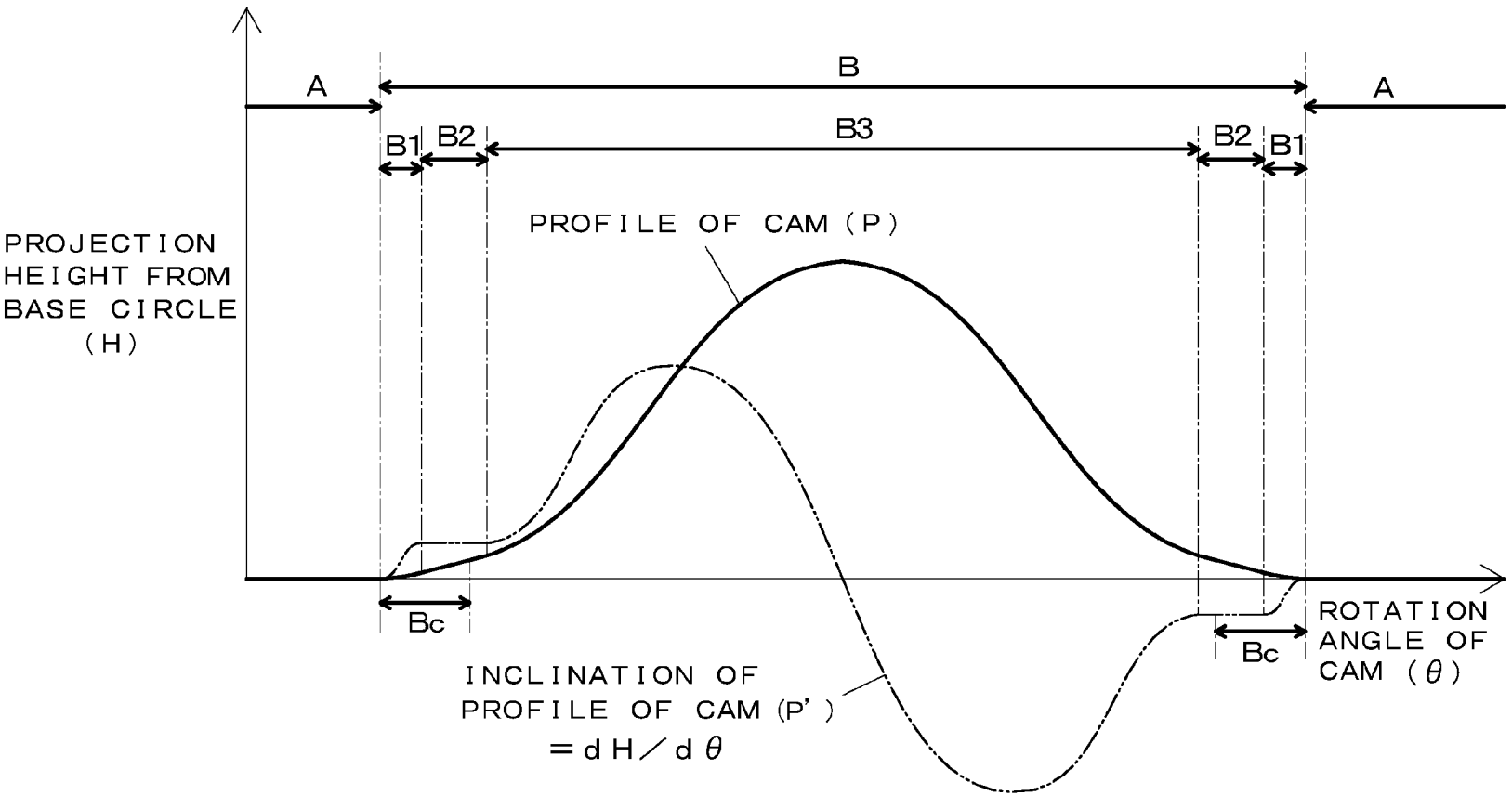
FIG. 8 is a graph illustrating the profile of a cam of the variable valve mechanism according to the first embodiment.

Particularly, the displacement clearance c1 is formed to have such a size that permits the relative displacement only in ranges Bc and Bc, which are included in both the connection sections B1 and B1 and the uniform velocity sections B2 and B2, and that does not permit the relative displacement in the main lift section B3 at the coupled time as illustrated in FIG. 8. The following describes the base circle time at the coupled time. That is, as illustrated in FIG. 6B, the displacement clearance c1 is formed between one end of the inner peripheral surface of each second pin hole 64 in the relative displacement direction and the outer peripheral surface of the switching pin 66. In addition, an adjustment clearance c2 that does not permit the relative displacement is formed between the other end of the inner peripheral surface in the relative displacement direction and the outer peripheral surface of the switching pin 66. The size of the displacement clearance c1 is about 0.15 mm. The size of the adjustment clearance c2 is about 0.75 mm.

The switching pins 66 and 66 are provided on the axis of the roller 38, and are specifically provided inside the roller shaft 36. The switching pins 66 and 66 are composed of a first switching pin 66 and a second switching pin 66 arranged side by side with a space therebetween in the longitudinal direction of the roller shaft 36. Each switching pin 66 includes a large diameter portion 66*a* and a small diameter portion 66*b* arranged side by side in the longitudinal direction of the roller shaft 36. Particularly, each switching pin 66 includes the large diameter portion 66*a* provided on the inner side in the width direction of the rocker arm 30, and the small diameter portion 66*b* provided on the outer side in the width direction. The large diameter portion 66*a* is formed to have such a dimension that the outer peripheral surface of the large diameter portion 66*a* is in sliding contact with the inner peripheral surface of the roller shaft 36 without a gap therebetween. Meanwhile, the small diameter portion 66*b* is formed to have such a dimension that there is a gap between the outer peripheral surface of the small diameter portion 66*b* and the inner peripheral surface of the roller shaft 36.

The guide members 67 and 67 are tubular members attached inside the roller shaft 36 so as to be undisplaceable in the longitudinal direction of the roller shaft 36. Each guide member 67 is formed to have such a dimension that the outer peripheral surface of the guide member 67 abuts against the inner peripheral surface of the roller shaft 36 without a gap therebetween and the inner peripheral surface of the guide member 67 is in sliding contact with the outer peripheral surface of the small diameter portion 66*b* without a gap therebetween.

The oil passage 72 extends to the hydraulic chambers 73 and 73 by way of the support member 20 and the input member 31. The hydraulic chambers 73 and 73 are provided inside the input member 31, and are specifically provided inside the roller shaft 36. Particularly, the hydraulic chambers 73 and 73 are composed of a first hydraulic chamber 73 and a second hydraulic chamber 73 arranged side by side with a space therebetween in the longitudinal direction of the roller shaft 36. Each hydraulic chamber 73 is formed by the inner peripheral surface of the roller shaft 36, the outer peripheral surface of the small diameter portion 66*b*, the end surface of the large diameter portion 66*a*, and the end surface of the guide member 67. The return spring 79 is interposed between the first switching pin 66 and the second switching pin 66 inside the roller shaft 36.

According to the first embodiment, the following effects A to G can be obtained.

[A] The tappet clearance C can be eliminated using a simple structure that is different from a lash adjuster or the like by providing the displacement clearance c1.

[B] The absence of the tappet clearance C eliminates anxiety that the rocker arm 30 may be lifted from the support member 20 by the switching hydraulic pressure applied to the oil passage 72 by an amount corresponding to the tappet clearance C to reduce the switching hydraulic pressure. Hence, it is possible to secure the stability of the switching hydraulic pressure by securing the sealability of the oil passage 72 at the boundary portion between the support member 20 and the rocker arm 30.

[C] The lost motion spring 50 urges the output member 41 toward the valve 7 using the reaction force generated when the input member 31 is urged toward the cam 10 at the non-coupled time. Thus, there is no anxiety that the output member 41 may flutter at the non-coupled time even without the different cam described above.

[D] The second pin holes 64 and 64 permit the relative displacement only in the ranges Bc and Bc, which are included in both the connection sections B1 and B1 and the uniform velocity sections B2 and B2, and do not permit the relative displacement in the main lift section B3 at the coupled time. Thus, there is no anxiety that the stroke of the relative displacement at the coupled time may be excessively large. Therefore, there is no anxiety that the valve lift amount maybe smaller than necessary, or no anxiety that an impact at the end point of the relative displacement at the coupled time may be excessively large.

[E] At the base circle time at the coupled time, the displacement clearance c1 and the adjustment clearance c2 are formed on both sides of the switching pin 66 in the relative displacement direction. Thus, the proportions of the displacement clearance c1 and the adjustment clearance c2 can be changed by just replacing the shim 8 fitted at the stem end of the valve 7 with a shim with a different thickness. Therefore, the size of the displacement clearance c1 (the size of the tappet clearance C which would originally be formed) can be adjusted easily. With formation of the adjustment clearance c2, further, the urging force of the lost motion spring 50 which urges the input member 31 toward the base circle 11 is not lost but secured even at the base circle time at the coupled time. Thus, the input member 31 can be reliably caused to abut against the base circle 11.

[F] The switching pins 66 and 66 are provided on the axis of the roller 38 which is driven by the cam 10. Therefore, the relative displacement at the non-coupled time is simplified compared to a case where the switching pins are provided near the center of swing. Therefore, the structure of the rocker arm 30 is simplified.

[G] The presence of the roller 38 allows the hydraulic chambers 73 and 73 to be provided inside the input member 31 which is wide. Thus, the rocker arm 30 is unlikely to be wide compared to a case where the hydraulic chambers are provided inside the output member 41. Therefore, the rocker arm 30 can be made compact in the width direction. Therefore, the present invention can be implemented even in an aspect in which only one valve 7 is driven by one rocker arm 30 as in the embodiment.

Second Embodiment

Figure 9B:
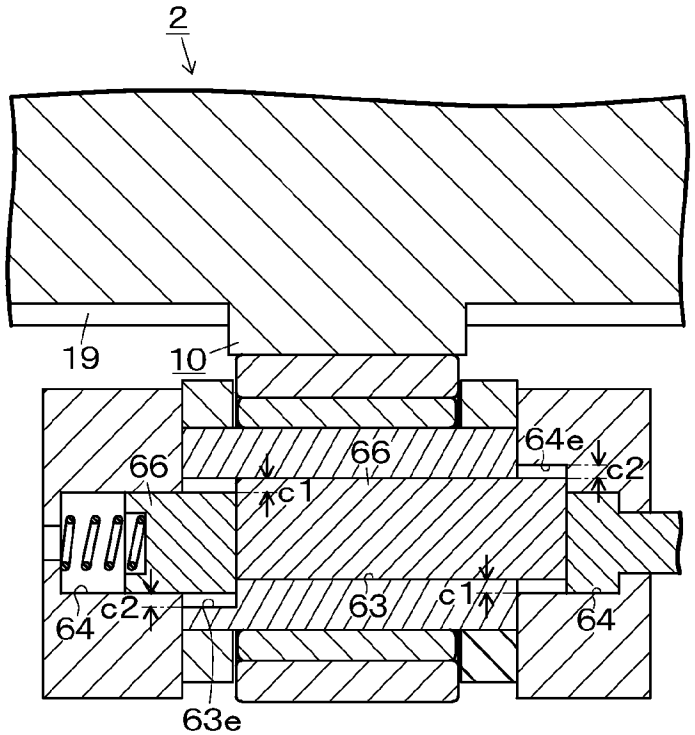
FIG. 9B is a front sectional view illustrating the variable valve mechanism according to the second embodiment at the coupled time immediately after the transition.
Figure 9A:
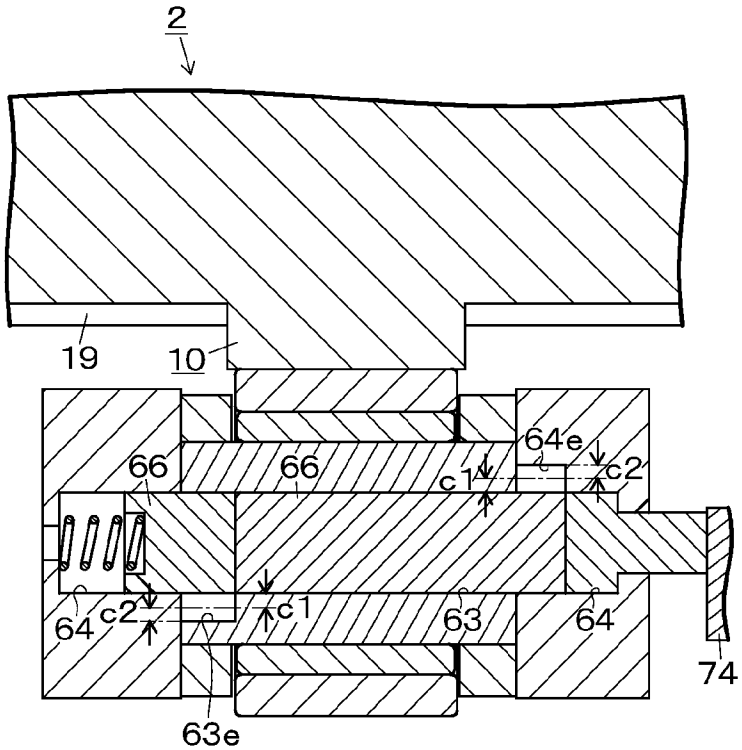
FIG. 9A is a front sectional view illustrating a variable valve mechanism according to a second embodiment at a coupled time immediately before a transition from a nose time to a base circle time.
Figure 10:
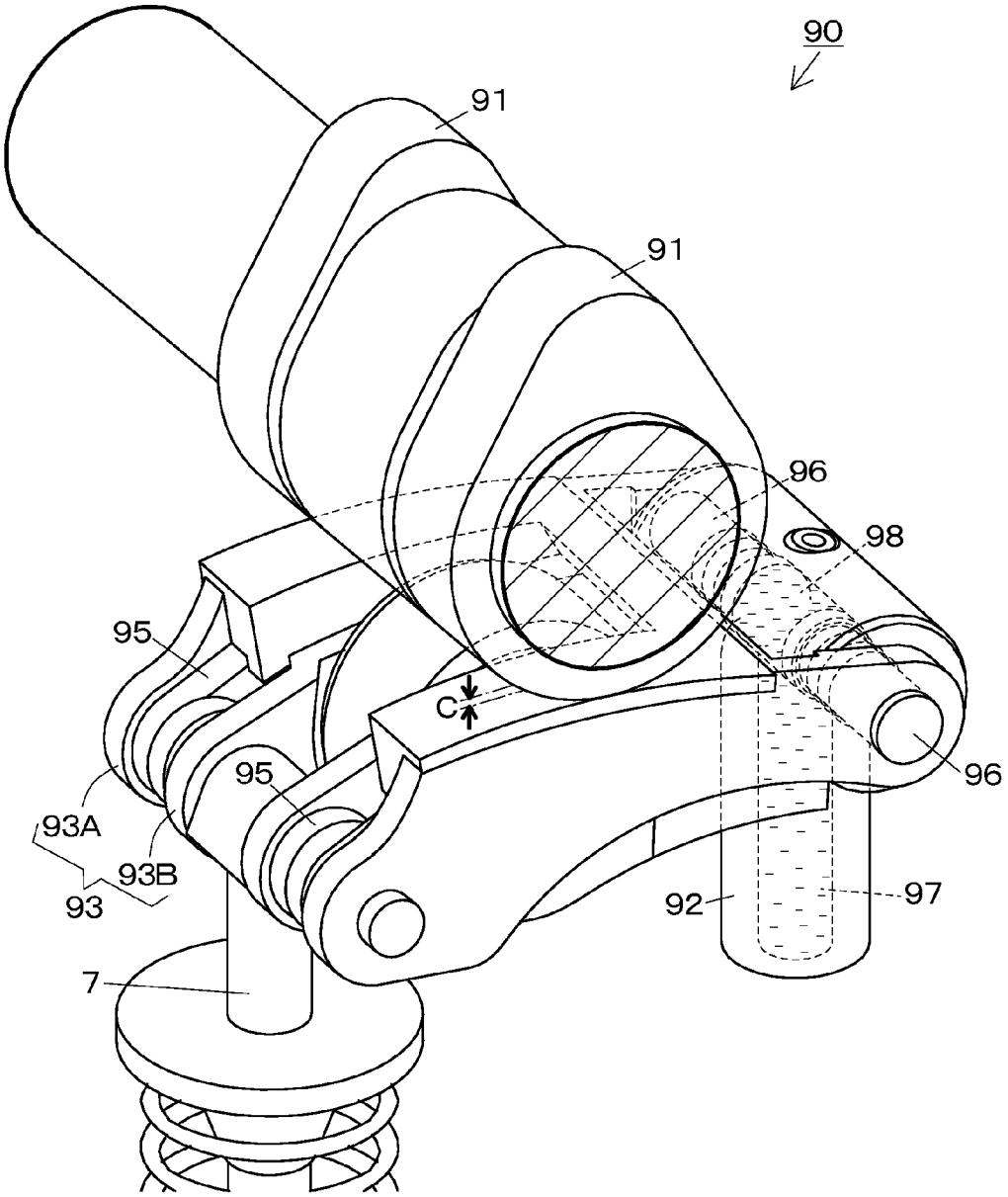
FIG. 10 RELATED ART
FIG. 10 is a perspective view illustrating a variable valve mechanism according to the related art.

A variable valve mechanism 2 of an internal combustion engine according to a second embodiment illustrated in FIGS. 9A and 9B is different from that according to the first embodiment in the following points, and otherwise similar thereto. That is, instead of displacing the two switching pins 66 and 66 to the non-coupling position which is on the inner side of the rocker arm 30 in the width direction using the hydraulic pressure in the hydraulic chambers 73 and 73 and displacing the two switching pins 66 and 66 to the coupling position which is on the outer side of the rocker arm 30 in the width direction using the urging force of the return spring 79, the two switching pins 66 and 66 are displaced to the non-coupling position which is on one side of the rocker arm 30 in the width direction using a pressing device 74 provided outside the rocker arm 30, and displaced to the coupling position which is on the other side of the rocker arm 30 in the width direction using the urging force of the return spring 79. Instead of the two second pin holes 64 and 64 being formed to be elongated in the relative displacement direction, one end portion 63*e* of the first pin hole 63 is formed to be elongated on one side in the relative displacement direction, and one end portion 64*e* of the second pin hole 64 is formed to be elongated on the other side in the relative displacement direction. Consequently, the displacement clearance c1 and the adjustment clearance c2 are formed at the coupled time.

Also according to the second embodiment, the effects A and C to F described above can be obtained.

The present invention is not limited to the configurations according to the embodiments described above, and may be implemented as modified as appropriate without departing from the scope and spirit of the invention as in the following modifications, for example.

First Modification

The output member 41 may be driven by a low-lift cam with a small lift amount or action angle compared to the cam 10. In this case, a low-lift state in which the valve 7 is driven with a small lift amount or action angle compared to the normal state, rather than the resting state, is established at the non-coupled time.

Second Modification

Two valves 7 and 7 may be driven by one rocker arm 30.

REFERENCE SIGNS LIST

1 Variable valve mechanism (first embodiment)
2 Variable valve mechanism (second embodiment)
7 Valve
10 Cam
11 Base circle
12 Nose
20 Support member
30 Rocker arm
31 Input member
36 Roller shaft
38 Roller
41 Output member
50 Lost motion spring
60 Switching device
63 First pin hole
64 Second pin hole
65 Switching pin
72 Oil passage
73 Hydraulic chamber
79 Return spring
C Tappet clearance
c1 Displacement clearance
c2 Adjustment clearance P Profile of cam
P' Inclination of profile of cam
A Base circle section
B Nose section
B1 Connection section
B2 Uniform velocity section
B3 Main lift section
Bc Range permitting relative displacement

The invention claimed is:

1. A variable valve mechanism of an internal combustion engine, comprising:

a rocker arm including an input member driven by a cam and an output member that drives a valve when swung;

a switching device that includes a first pin hole provided in the input member, a second pin hole provided in the output member, and a switching pin, and that switches a drive state of the valve by displacing the switching pin between a coupling position at which the switching pin extends between the first pin hole and the second pin hole and a non-coupling position at which the switching pin does not extend between the first pin hole and the second pin hole; and a lost motion spring that urges the input member toward the cam at a non-coupled time when the switching pin is disposed at the non-coupling position, wherein a displacement clearance in a direction of relative displacement of the input member with respect to the output member at the non-coupled time is formed between an inner peripheral surface of the first or second pin hole and an outer peripheral surface of the switching pin to permit the relative displacement in a range of the displacement clearance at a coupled time when the switching pin is disposed at the coupling position so that a tappet clearance is not formed between a base circle of the cam and the input member with the input member urged toward the cam by the lost motion spring also at the coupled time.

2. The variable valve mechanism of an internal combustion engine according to claim 1, wherein the rocker arm is swingably supported by a support member that does not automatically compensate for the tappet clearance.

3. The variable valve mechanism of an internal combustion engine according to claim 2, wherein the support member is a pivot.

4. The variable valve mechanism of an internal combustion engine according to claim 3, wherein the rocker arm includes a hemispherical recessed portion provided in a lower surface of a base end portion of the input member, the support member includes a hemispherical portion provided at an upper end portion thereof, and the hemispherical recessed portion is swingably placed on the hemispherical portion.

5. The variable valve mechanism of an internal combustion engine according to claim 1, wherein:

the rocker arm is swingably placed on a support member that projects upward; and the switching device includes a hydraulic chamber provided inside the rocker arm, and an oil passage that extends to the hydraulic chamber by way of the support member and the rocker arm, and is configured to displace the switching pin in accordance with variations in hydraulic pressure in the oil passage and the hydraulic chamber.

6. The variable valve mechanism of an internal combustion engine according to claim 5, wherein:

the input member includes a roller that rotatably abuts against the cam; and the switching pin is provided on an axis of the roller, and the hydraulic chamber is provided inside the input member.

7. The variable valve mechanism of an internal combustion engine according to claim 1, wherein a different cam that is different from the cam and that abuts against the output member at the non-coupled time is not provided, and the lost motion spring is configured to urge the output member toward the valve using a reaction force generated when the input member is urged toward the cam at the non-coupled time so that the output member does not flutter at the non-coupled time even without the different cam.

8. The variable valve mechanism of an internal combustion engine according to claim 1, wherein:

the cam has a profile including, as seen in a graph having a horizontal axis indicating a rotational angle of the cam and a vertical axis indicating a projection height from the base circle, two uniform velocity sections in which an inclination of the profile is constant and which are provided on an inner side of connection sections provided at both end portions of a nose section, and a main lift section provided on an inner side of the uniform velocity sections; and the displacement clearance is formed to have such a size that permits the relative displacement only in ranges, which are included in both the connection sections and the uniform velocity sections, and that does not permit the relative displacement in the main lift section at the coupled time.

9. The variable valve mechanism of an internal combustion engine according to claim 1, wherein at a base circle time, in which the base circle acts, at the coupled time, the displacement clearance is formed between one end of the inner peripheral surface of the first or second pin hole in a direction of the relative displacement and the outer peripheral surface of the switching pin, and an adjustment clearance that does not permit the relative displacement is formed between the other end of the inner peripheral surface in the direction of the relative displacement and the outer peripheral surface of the switching pin.

* * * * *